US006986167B1

(12) United States Patent
Coutant et al.

(10) Patent No.: US 6,986,167 B1
(45) Date of Patent: Jan. 17, 2006

(54) PROTECTIVE HEADGEAR

(75) Inventors: Andy Coutant, Sammamish, WA (US); Thomas M. Lukens, Bellevue, WA (US)

(73) Assignee: ASICS Corporation, Kobe (JP)

( * ) Notice: Subject to any disclaimer, the term of this patent is extended or adjusted under 35 U.S.C. 154(b) by 69 days.

(21) Appl. No.: 10/704,321

(22) Filed: Nov. 10, 2003

Related U.S. Application Data

(63) Continuation-in-part of application No. 29/191,725, filed on Oct. 14, 2003, now Pat. No. Des. 499,847, and a continuation-in-part of application No. 29/191,726, filed on Oct. 14, 2003, now Pat. No. Des. 500,894, and a continuation-in-part of application No. 29/191,727, filed on Oct. 14, 2003, now Pat. No. Des. 500,179.

(51) Int. Cl.
*A63B 71/10* (2006.01)

(52) U.S. Cl. ..... 2/425

(58) Field of Classification Search ..... 2/425, 2/421, 209, 9, DIG. 11; 128/207.11; D29/106, D29/112; D2/877, 878
See application file for complete search history.

(56) References Cited

U.S. PATENT DOCUMENTS 1,514,516 A * 11/1924 Golomb ..... 2/9
1,716,550 A * 6/1929 Hart ..... 2/9
1,873,864 A * 8/1932 Ely ..... 128/866
2,898,596 A * 8/1959 Keen ..... 2/421
3,327,316 A * 6/1967 Pukish, Jr ..... 2/421
3,596,288 A 8/1971 Marchello
3,964,653 A * 6/1976 Strutz ..... 224/257
4,279,037 A 7/1981 Morgan
4,377,009 A 3/1983 Douglas
4,551,861 A 11/1985 Marchello
4,621,378 A * 11/1986 Hatchman ..... 2/9
4,710,985 A * 12/1987 Dubner et al. ..... 2/425
4,754,501 A 7/1988 Yahn
4,796,307 A 1/1989 Vantine (Continued)

*Primary Examiner*—Rodney M. Lindsey
(74) *Attorney, Agent, or Firm*—Michael E. Zall

(57) ABSTRACT

Protective headgear is provided having cushioned ear guards and a head support connecting the ear guards and cradling a wearer's head to provide a comfortable and stable fit during use. The head support comprises first and second lateral straps interconnecting the ear guards, and a transverse strap having a central portion and forward and rear legs for interconnection with the lateral straps. The ear guards include an outer later having a nylon laminate, a shell portion having a plurality of slots for receiving ends of the head support, a landing pad attached to the perimeter of the shell portion, and an inner layer attached along the perimeter thereof to the outer layer and including a cushioning material that aligns with the landing pad and cushions the head of a wearer. The ear guards also include a plurality of raised ventilation areas in the shell that align with apertures in the outer layer to provide ventilation for the wearer.

22 Claims, 10 Drawing Sheets

U.S. PATENT DOCUMENTS

| | | | | | |
|---|---|---|---|---|---|
| 4,821,345 | A | | 4/1989 | Marchello | |
| D315,812 | S | | 3/1991 | Cionni | |
| 5,075,903 | A | * | 12/1991 | Richoux | 2/411 |
| 5,168,576 | A | | 12/1992 | Krent et al. | |
| 5,184,354 | A | * | 2/1993 | Alfaro et al. | 2/425 |
| 5,228,143 | A | | 7/1993 | Marchello | |
| 5,361,420 | A | | 11/1994 | Dobbs et al. | |
| 5,500,951 | A | | 3/1996 | Marchello | |
| 5,504,945 | A | | 4/1996 | Purnell | |
| D381,646 | S | | 7/1997 | Taylor et al. | |
| D384,774 | S | | 10/1997 | Tsujino | |
| 5,685,021 | A | | 11/1997 | Tsujino | |
| 5,768,715 | A | * | 6/1998 | Gregg et al. | 2/411 |
| 5,881,393 | A | | 3/1999 | Marchello | |
| D411,200 | S | | 6/1999 | Almqvist | |
| 6,058,516 | A | | 5/2000 | Purnell | |
| D429,035 | S | | 8/2000 | Purnell | |
| 6,131,196 | A | | 10/2000 | Vallion | |
| D442,340 | S | | 5/2001 | Leight et al. | |
| D443,729 | S | | 6/2001 | Tsujino | |
| D443,730 | S | | 6/2001 | Tsujino | |
| D443,955 | S | | 6/2001 | Tsujino | |
| 6,289,522 | B1 | | 9/2001 | Jones et al. | |
| 6,381,760 | B1 | * | 5/2002 | Lampe et al. | 2/425 |
| D459,034 | S | | 6/2002 | Dix et al. | |
| 6,418,565 | B1 | | 7/2002 | Tsujino | |
| D469,928 | S | | 2/2003 | Keen et al. | |
| 6,550,064 | B2 | * | 4/2003 | Schmitt et al. | 2/10 |
| 6,553,569 | B2 | * | 4/2003 | Bush | 2/9 |
| 6,557,186 | B1 | | 5/2003 | Purnell | |
| 6,564,395 | B2 | | 5/2003 | Keen | |
| 2002/0002733 | A1 | | 1/2002 | Keen | |
| 2002/0083512 | A1 | | 7/2002 | Tsujino | |

* cited by examiner

PROTECTIVE HEADGEAR

RELATED APPLICATIONS

This application is a continuation-in-part application of Application Ser. Nos. 29/191,725, Patent D, 499,847, 29/191,726, Patent D 500,894, and 29/191,727, Patent D 500,179 all of which were filed on Oct. 14, 2003. The entire disclosures of these applications are expressly incorporated herein by reference.

BACKGROUND OF THE INVENTION

1. Field of the Invention

The present invention relates to protective headgear. More specifically, the present invention relates to protective headgear having cushioned, multi-layer ear guards and a head support configuration that securely and comfortably cradles a wearer's head.

2. Related Art

In various sports, such as wrestling, it is necessary to protect a participant's head and ears from injury. Various headgear designs have been developed to achieve this goal, most of which include a pair of ear guards that fit about the wrestler's ear, interconnected by a plurality of adjustable straps for securing the headgear to the wrestler's head. Further, various cushioning systems have been developed and incorporated with such ear guards to provide added comfort for the wearer. However, a particular problem with existing cushioning systems is that such systems do not adequately provide protection from shock while retaining a comfortable fit during use. Further, many existing ear guards do not provide adequate ventilation for the wearer.

Additionally, present headgear designs include a plurality of straps interconnecting the ear guards of the headgear. Frequently, such straps include buckles or other attachment means that must be individually adjusted and tightened to provide a suitable fit for the wearer, thereby requiring time and effort on the part of the wearer prior to a sporting event. Moreover, existing headgear designs are prone to slippage, wherein one or more of the straps shift position during a sporting event, thereby leading to an uncomfortable and potentially dangerous situation. Indeed, most headgear straps are cumbersome to operate and wear, and do not conform to or "cradle" the shape of the wearer's head to provide a reliable and comfortable fit. Additionally, the straps of existing headgear do not provide sufficient cushioning for the wearer's head.

Accordingly, what is desired, but has heretofore not been provided, is protective headgear wherein sufficient cushioning is provided, and wherein a comfortable and reliable fit is provided about the head of the wearer.

SUMMARY OF THE INVENTION

The present invention relates to protective headgear. The headgear includes a pair of ear guards joined by a head support that cradles the top of the wearer's head to provide a comfortable and stable fit during use. The head support includes first and second lateral straps connected at ends thereof to the ear guards, and a transverse strap interconnecting the first and second lateral straps. The transverse strap includes a central body with frontward and rearward legs attached at ends thereof to the first and second lateral straps. The transverse and lateral straps can be adjusted to provide a desired fit about and to "cradle" the head of the wearer. An adjustable chin strap is attached at ends to the ear guards, and can be selectively adjusted to provide a desired fit about the chin of the wearer.

The present invention also relates to a protective headgear having one or more head straps that include a cushioning material within the straps for cushioning the head of a wearer during use. The cushioning material is positioned between the layers of material forming the strap. The cushioned head straps absorb shock occurring during a sporting event, and provide a comfortable fit.

The present invention further provides an ear guard that cushions the head of the wearer when the ear guard is worn. The ear guard includes a shell portion surrounded by an outer wall and an annular inner wall. The shell portion includes a plurality of slots for the connection of head straps thereto. The outer wall forms the exterior of the ear guard, and can include a nylon laminate material, and is joined along the perimeter thereof to the inner wall. A landing pad surrounds the perimeter of the shell. The inner wall and outer wall retain the shell portion therebetween, and the inner wall includes a compressible material that aligns with the landing pad and provides cushioning for the head of the wearer.

The present invention also provides an ear guard having plural ventilation areas for providing ventilation and transmitting sound to a wearer's ears. The ear guard includes an outer wall, and an annular wall joined at the perimeter thereof to the outer wall, and a shell positioned between the inner and outer walls. The ventilation areas, each of which include a plurality of apertures, are formed in the shell. The ventilation areas are on raised portions of the shell and protrude through apertures in the outer wall. The outer wall can be formed of a plastic material, and a nylon laminate can be provided on the outer surface of the outer wall. A landing pad surrounds the perimeter of the shell. The inner wall includes a cushioning material that aligns with the landing pad and cushions the head of a wearer.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

The present invention relates to protective headgear having cushioned, multi-layer ear guards and a head support connecting the ear guards and cradling a wearer's head to provide a comfortable and stable fit during use. The head support comprises first and second lateral straps interconnecting the ear guards, and a transverse strap interconnecting the lateral straps. The transverse strap includes a central portion and legs on opposite sides of the central portion which interconnect with the lateral straps. A head strap construction is also provided, and includes a cushioning material disposed between layers of material forming the strap.

The ear guards of the present invention include an outer wall and an annular inner wall. A shell portion is positioned between the inner and outer walls, and includes a plurality of slots for attachment with head straps. A landing pad is attached about the perimeter of the shell. The inner wall is joined at a perimeter thereof to the outer wall, and includes a compressible material that aligns with the landing pad and provides cushioning for the head of the wearer. In one embodiment, the ear guards of the present invention include ventilation areas formed on raised portions of the shell. The outer wall includes apertures which accommodate the raised portions of the shell.

Figure 1:
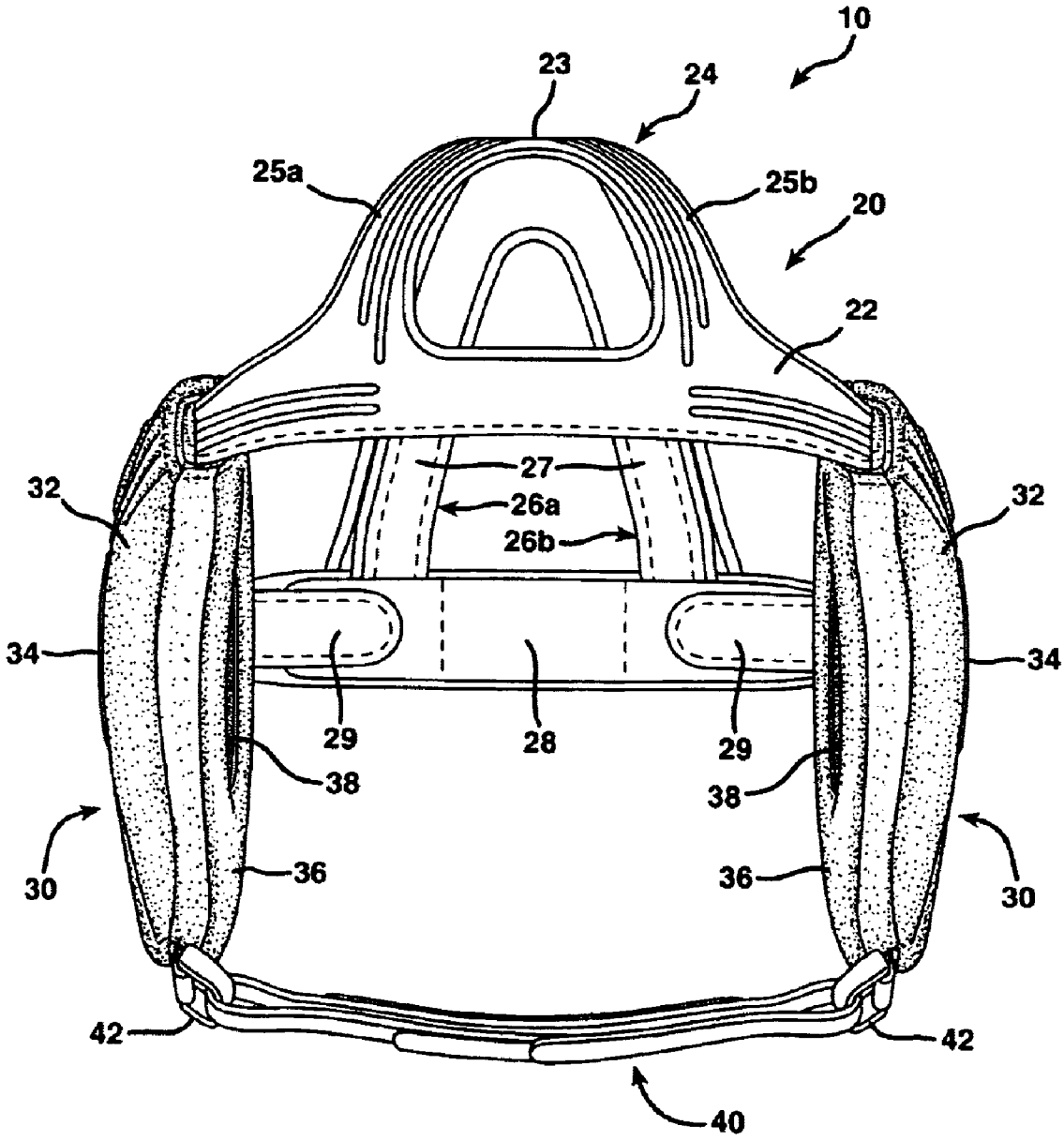
FIG. 1 is front view of the protective headgear of the present invention.

FIG. 1 is front view of the protective headgear of the present invention, indicated generally at 10. The headgear 10 comprises a head support 20 interconnected with ear guards 30. The head support 20 comprises a first lateral strap 22 and a second lateral strap 28. Ends 29 of the second lateral strap 28 are threaded through slots in the ear guards 30, and are releasably attached (e.g., via hook-and-loop fasteners) back onto the body of the second lateral strap 28, so that the overall length of the second lateral strap 28 can be adjusted as desired. The construction of the first lateral strap 22 is similar to that of the second lateral strap 28. Optionally, the ends of the straps could otherwise interconnect with the ear guards 30 such as by extending the ends of the straps through apertures in the ear guards and stitching the ends back onto the straps, or in any other manner known in the art.

A transverse strap 24 interconnects the first lateral strap 22 and the second lateral strap 28. The transverse strap 24 includes a central portion 23 and forward legs 25*a*, 25*b* and rear legs 26*a*, 26*b*, which interconnect with the first and second lateral straps, respectively. As shown in FIG. 1, rear legs 26*a*, 26*b* are releasably attached to the second lateral strap 28 by ends 27, which are threaded through slots in the second lateral strap 28 and releasably attached back onto the legs 26*a*, 26*b*. Optionally, the legs 27 could be stitched to the legs 26*a*, 26*b* or permanently attached thereto. If desired, the forward legs 25*a*, 25*b* could also be releasably attached to the first lateral strap 22, and the rear legs 26*a*, 26*b* could be fixedly or releaseably attached to the second lateral strap 28.

If desired, the head support 20 could be fabricated in a unitary construction, wherein the first lateral strap 22, the second lateral strap 28, the transverse strap 24, the forward legs 25*a*, 25*b*, and the rear legs 26*a*, 26*b* are formed together. Additionally, the head support 20 can be formed without the forward and rear legs 25*a*, 25*b*, 26*a*, and 26*b*, wherein a single transverse strap is attached at ends between the first lateral strap 22 and the second lateral strap 28, or the transverse strap could include one set of legs.

Important, the head support 20 cradles the head of a wearer to provide a secure and comfortable fit while wearing the headgear 10. The head support 20 can be made of any suitable, flexible material, such as a synthetic woven material. An adjustable chin strap 40 is provided and attached to the ear guards 30 by rings 42. The chin strap 40 can be attached to the ear guards 30 in any desired, known manner, such as by extending ends of the strap 40 through rings 42 and fastening the ends back onto the strap 40 with a hook-and-loop fastening system. The chin strap 40 can be adjusted to accommodate any desired fit.

The ear guards 30 are formed of a multi-layer construction and provide protection for a wearer's ears while maintaining a comfortable fit. Each of the ear guards 30 comprises an outer wall 32 having one or more apertures 34 for allowing the transmission of sound to the wearer's ear and for providing ventilation for the ear guards 30. An annular inner wall 36 contacts the head of the wearer around the wearer's ear, and is preferably formed from a smooth, compliant material, such as Neoprene. The inner wall 36 is joined along the perimeter thereof to the outer wall 32. Gaps are provided between the inner wall 36 and outer wall 32 are provided to allow for the engagement of head straps with the ear guards 30. The inner wall 36 includes a central aperture 38 for receiving a wearer's ear. The cavity within the ear guard 30 provides sufficient room for the ear to be comfortably housed and protected thereby.

Figure 2:
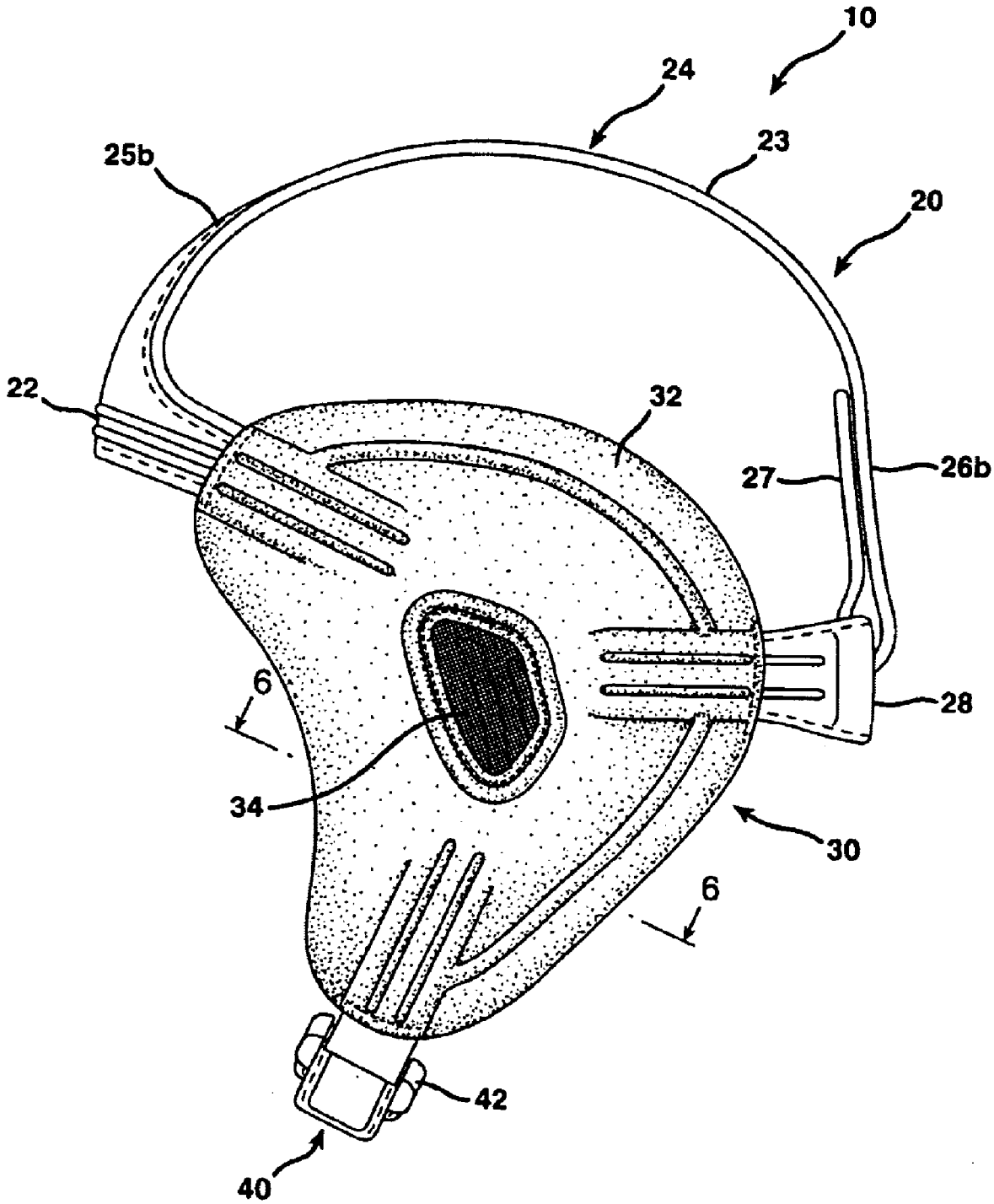
FIG. 2 is a side view of the protective headgear shown in FIG. 1.

FIG. 2 is a side view of the protective headgear 10 shown in FIG. 1. The first lateral strap 22 extends from the ear guard 30, and rests near the forehead of a wearer's head. The second lateral strap 28 extends from the ear guard 30, and rests against the back of the wearer's head. The transverse strap 24 is interconnected between the first and second lateral straps 22 and 28 by forward legs 25*a* (not shown) and 25*b*, and rear legs 26*a* (not shown) and 26*b*. Aperture 34 of the ear guard 30 can be covered with a mesh-like material, as shown, that allows sound and air to be transmitted therethrough. Alternatively, the aperture 34 could be left open.

Figure 3:
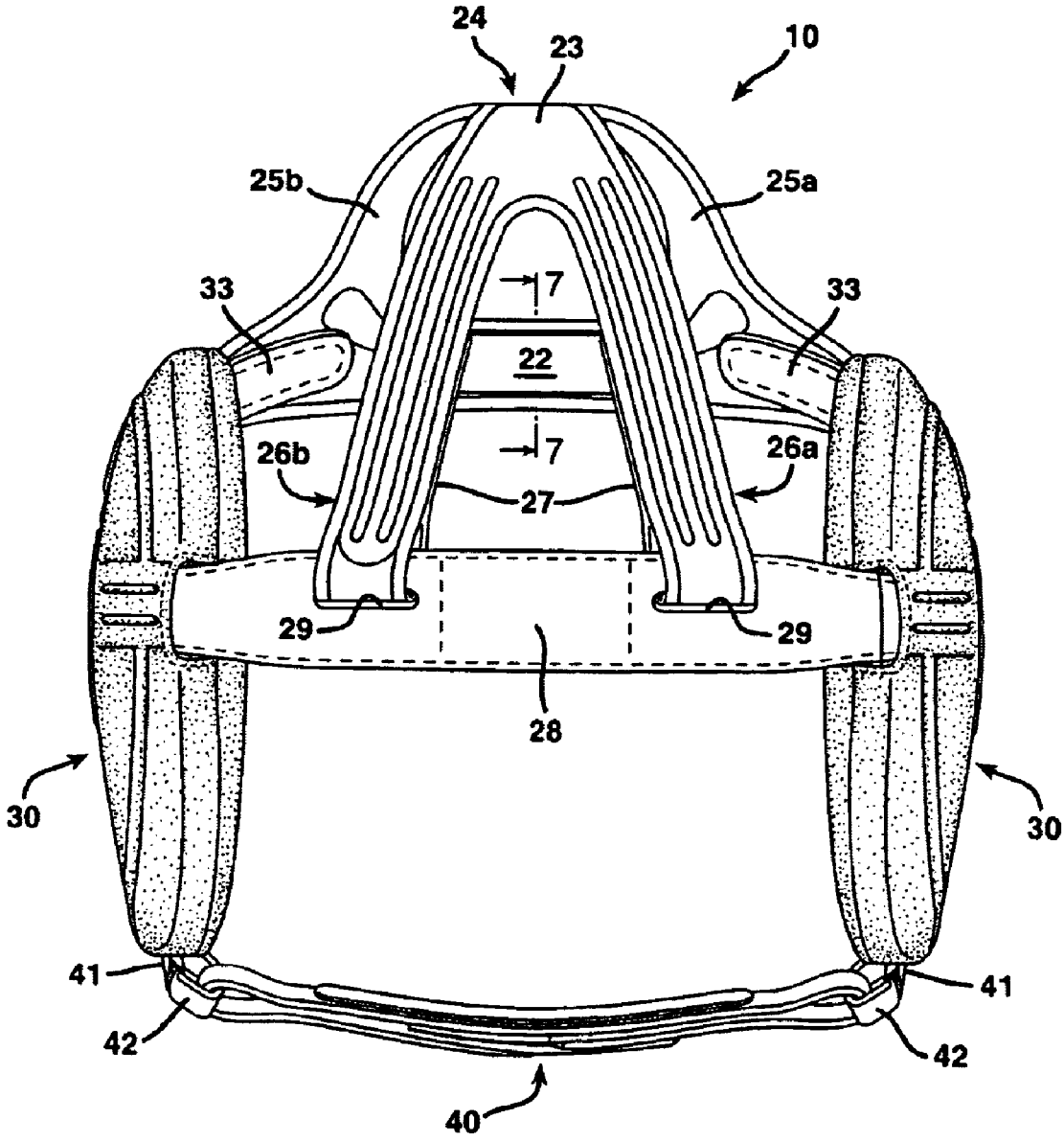
FIG. 3 is a rear view of the protective headgear shown in FIG. 1.

FIG. 3 is a rear view of the protective headgear 10 shown in FIG. 1. The forward legs 25*a*, 25*b* are attached to the first lateral strap 22, and connect the first lateral strap 22 to the transverse strap 24. The rearward legs 26*a*, 26*b* attach the transverse strap 24 to the second lateral strap 28 via ends 27 threaded through apertures 29 of the second lateral strap 28 and attached back on the rearward legs 26*a*, 26*b* (e.g., by hook-and-loop type fastener). Ends 33 of the first lateral strap 22 are threaded through slots in the ear guard 30, and are releasably attached back on the first lateral strap 22 by hook-and-loop type fasteners. Optionally, the ends 33 could be stitched or permanently attached to the first lateral strap 22. The chin strap 40 attaches at ends to the ear guards 30 by rings 42. Straps 41, interconnected with the car guards 30, support the rings 42.

Figure 4:
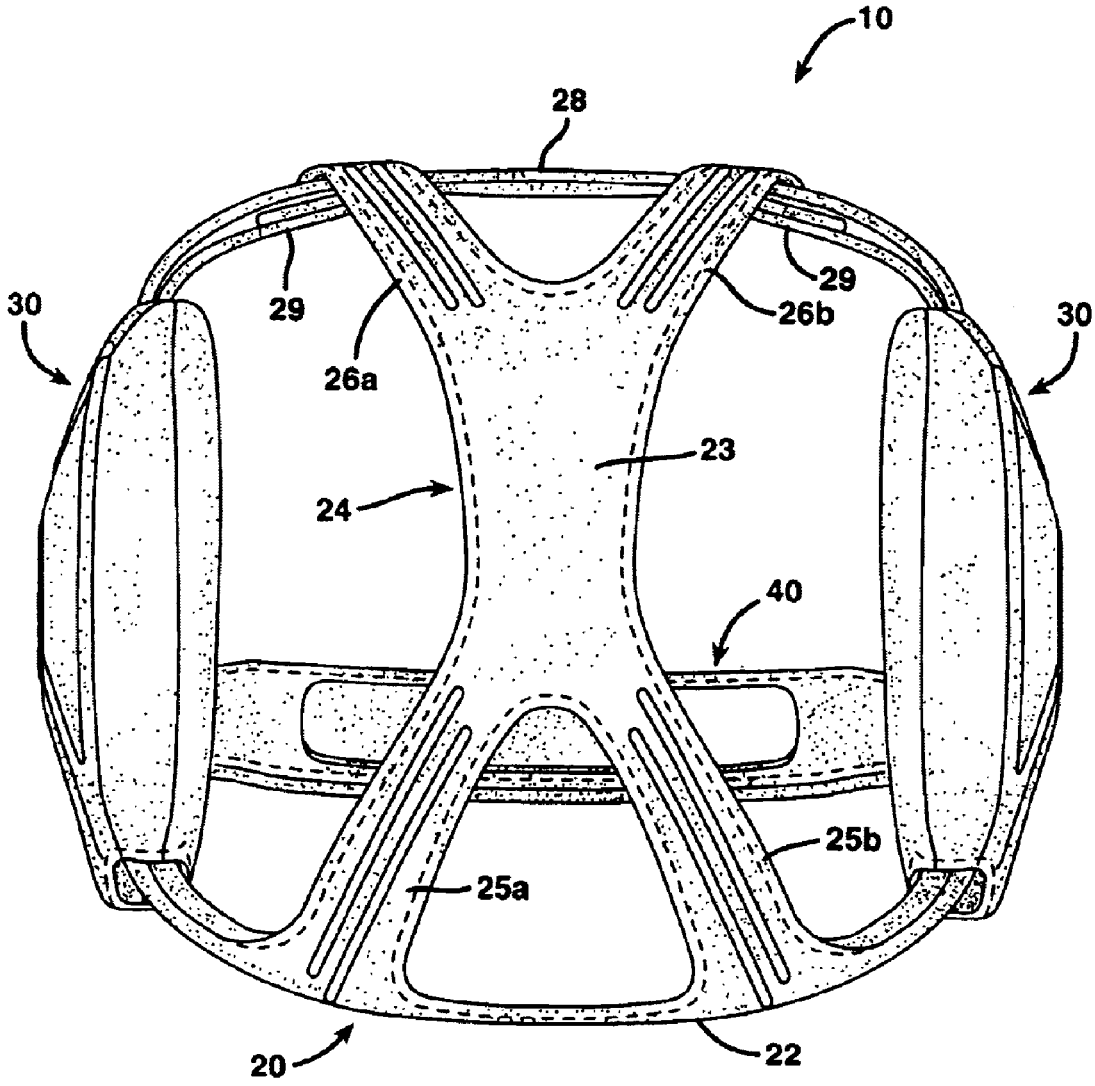
FIG. 4 is a top view of the protective headgear shown in FIG. 1.
Figure 5:
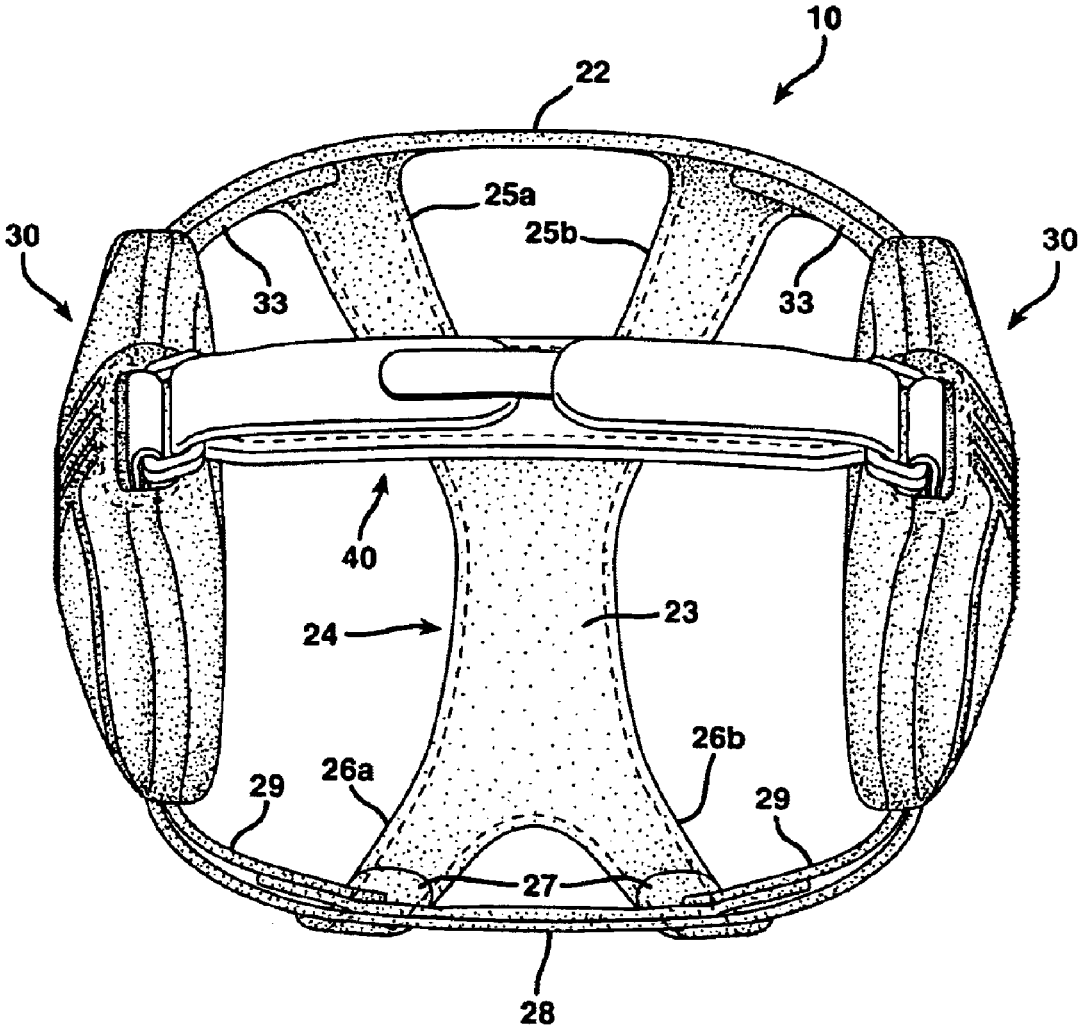
FIG. 5 is a bottom view of the protective headgear shown in FIG. 1.

FIGS. 4 and 5 are top and bottom views, respectively, of the headgear 10 shown in FIG. 1. As can be seen in FIG. 4, the head support 20 interconnects the ear guards 30, and provides a comfortable fit about the head of a wearer. The first lateral strap 22 and second lateral strap 28 are adjustable with relation to the ear guards 30, and the legs 26*a*, 26*b* are adjustable with relation to the second lateral strap 28. As can be seen in FIG. 5, such adjustment is provided by ends 33 of first lateral strap 22 can be releasably attachable by hook-and-loop fasteners, or otherwise attached. The chin strap 40 is also adjustable to accommodate a desired fit, and is connected between the ear guards 30.

Figure 6:
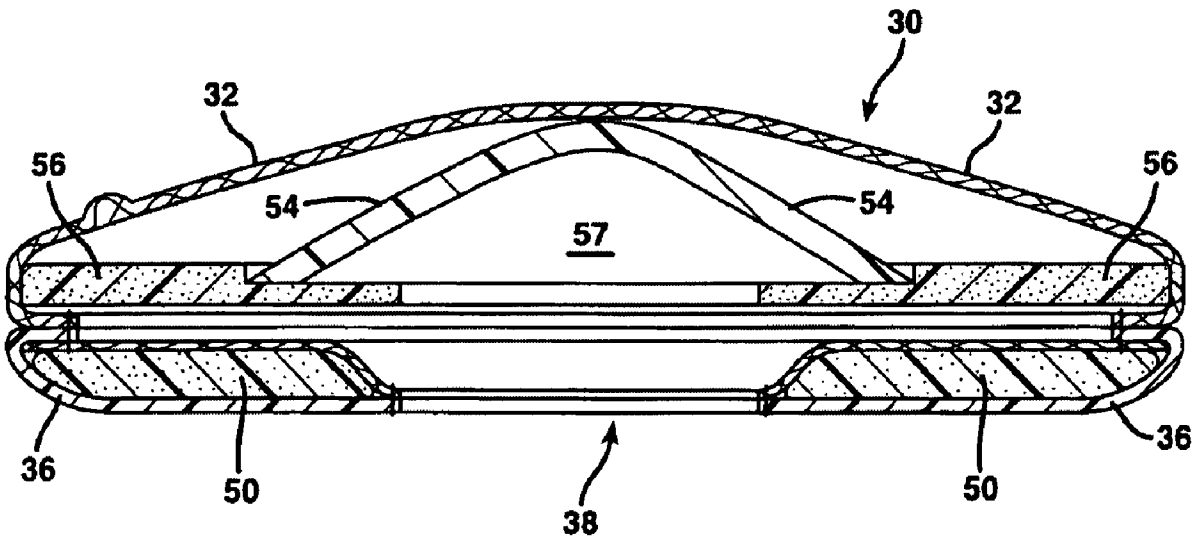
FIG. 6 is a cross-sectional view showing the ear guard of the present invention, taken along the line 6—6 of FIG. 2.

FIG. 6 is a cross-sectional view showing the ear guard 30 of the present invention, taken along the line 6—6 of FIG. 2. The ear guard 30 is lightweight, durable, and provides sufficient cushioning for the wearer's head to remain comfortable during use yet provide protection against injury. The outer wall 32 comprises a compressed, flexible material, such as ethylene vinyl acetate (EVA) that is optionally laminated with a nylon material to provide a smooth outer surface. A rigid inner shell 54 protects the wearer's ear, provides shape for the ear guard 30, and defines a cavity 57 for receiving a wearer's ear. The shell 54 preferably comprises a rigid polypropylene material, but could be manufactured from other suitable materials. A generally annular landing pad 56 formed of a compressible material such as EVA is attached to the perimeter of the shell 54.

An inner wall 36 is attached, such as by stitching, to the edges of the outer wall 32. Other methods of attachment of the components of the present invention, such as sonic welding, etc., are considered within the scope of the invention. The inner wall 36 can include an annular compressible or "memory" layer 50, which is retained in position by an annular backing. The memory layer 50 aligns with the landing pad 56. The memory layer 50 could be manufactured from a compressible foam material, such as KINETO foam material manufactured by Wind Enterprises, Inc. The memory layer 50 provides cushioning for the wearer's head while absorbing shocks occurring during a sporting event. Each of the layers of the ear guard 30 can be formed from readily-available materials to provide an ear guard that is lightweight yet sufficiently rigid to protect a wearer's ears from injury, while providing a cushioned fit that is comfortable to wear.

Figure 7:
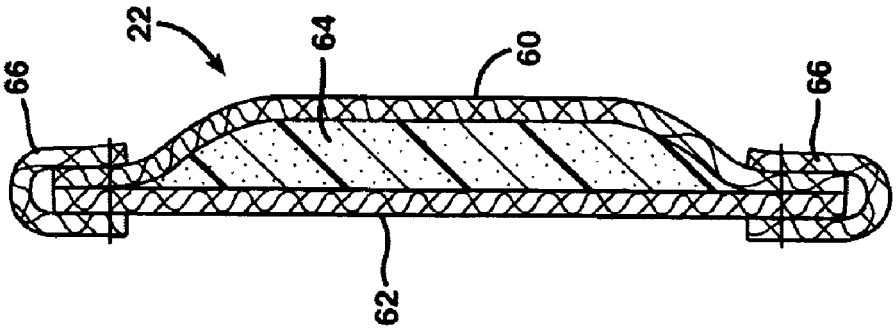
FIG. 7 is a cross-sectional view of one of the lateral straps of the protective headgear of the present invention, taken along the line 7—7 of FIG. 3.

FIG. 7 is a cross-sectional view of the first lateral strap 22 of the protective headgear of the present invention, taken along the line 7—7 of FIG. 3. The strap 22 can include a compressible material 64 positioned between walls 60 and 62 to protect the wearer against injury. The compliant material 64 could be the same material used for memory layer 50 of the ear guards 30 (e.g., KINETO foam material), or any other suitable material capable of absorbing shock while remaining relatively flexible. The walls 60 and 62 are joined at edges in any desired manner, such as by stitching. A welt 66 can be used to cover this junction between the walls 60 and 62, and stitched into place.

Figure 8:
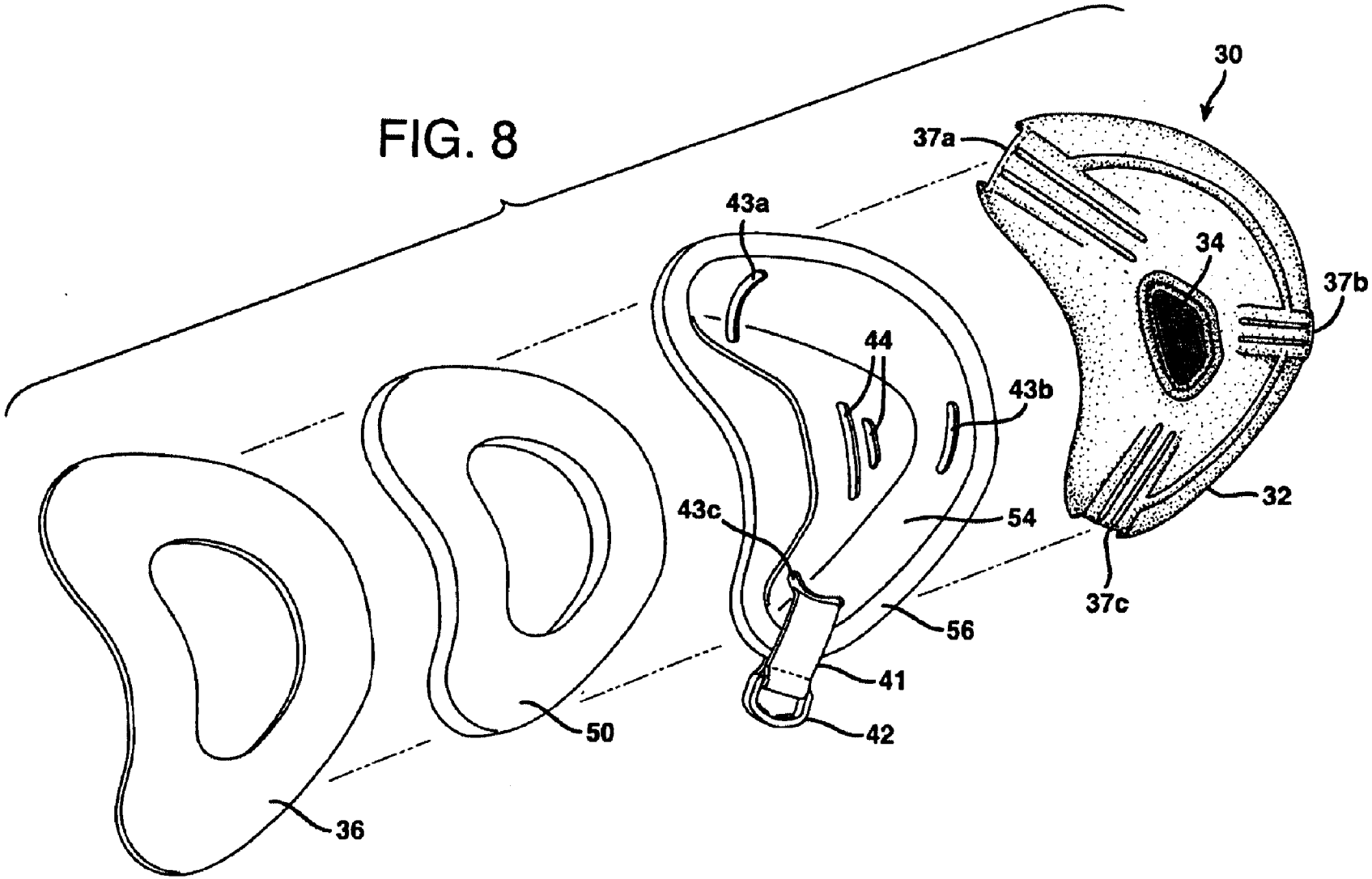
FIG. 8 is an exploded perspective view of the ear guard of the present invention.

FIG. 8 is an exploded view showing the components of the ear guard 30 of the present invention. The ear guard 30 could be crescent-shaped, but any other desired shape can be utilized without departing from the spirit or scope of the present invention. The shell 54 includes a plurality of slots 43*a*, 43*b*, and 43*c* for engagement with head straps. Aperture 43*c* is positioned for interconnection with a chin strap. It can receive a loop 41 of material to which a ring 42 is connected. The ring 42 receives an end of the adjustable chin strap 40. A plurality of apertures 44 are provided on the shell 54 to allow air and sound to be transmitted through the shell 54. This allows a wearer to hear while wearing the headgear of the present invention, and also provides ventilation.

Apertures 44 align with the aperture 34 of outer wall 32. As mentioned earlier, the aperture 34 could be covered with a mesh-like material capable of transmitting air and sound, or left open. The memory layer 50 aligns with the landing pad 56, and the memory layer 50, the landing pad 56, and the shell 54 are partially enclosed by the outer wall 32 and the inner wall 36. The outer layer 32 includes a plurality of slits 37*a*, 37*b*, and 37*c* along the seam formed at the union of outer layer 32 and inner layer 36 to allow head and chin straps to be inserted therethrough for engagement with apertures 43*a*, 43*b*, and 43*c* of the shell 54.

Figure 9:
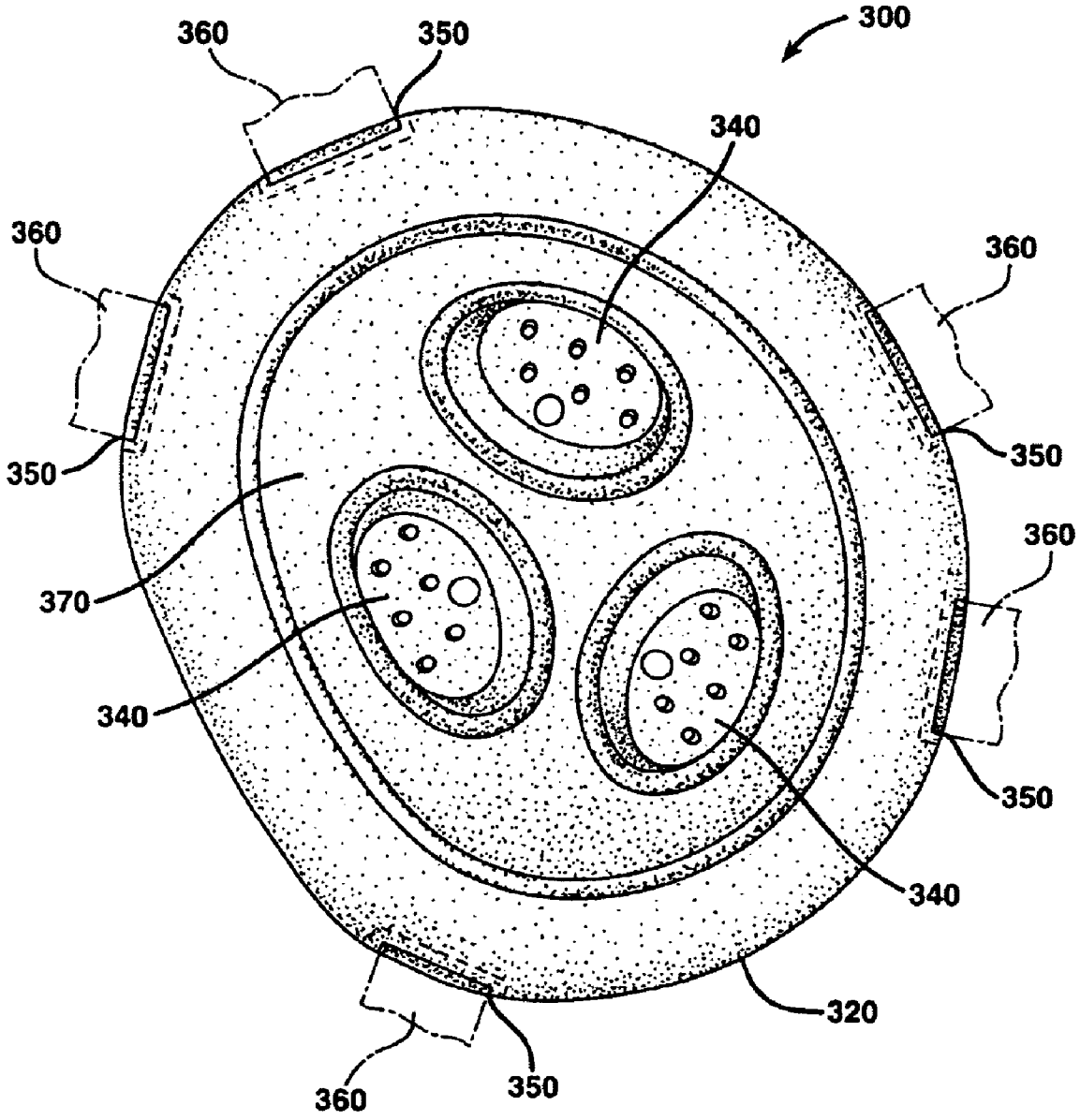
FIG. 9 is a side view showing another ear guard according to the present invention.

FIG. 9 is a side view showing another embodiment of the ear guard of the present invention, indicated generally at 300. Again, the ear guard 300 comprises a perimeter area 320 that includes a plurality of slots 350 for allowing attachment to straps 360. A dome-shaped central portion 370 is provided, and includes ventilation areas 340 disposed generally radially from the center of the dome-shaped central portion 370, and positioned on elevated surfaces of the shell. Each of the ventilation areas includes a plurality of apertures for allowing air and sound to transmit through the ear guard 300. This ear guard 300 is formed of a multi-layer construction similar to ear guard 30, discussed earlier.

Figure 10B:
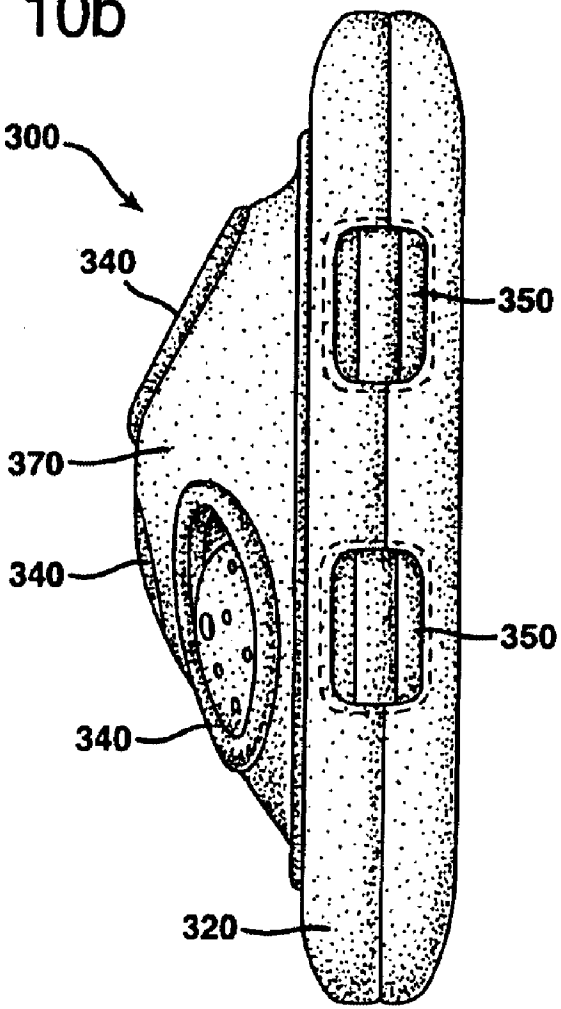
FIGS. 10*a*–10*b* are end views of the ear guard shown in FIG. 9.
Figure 10A:
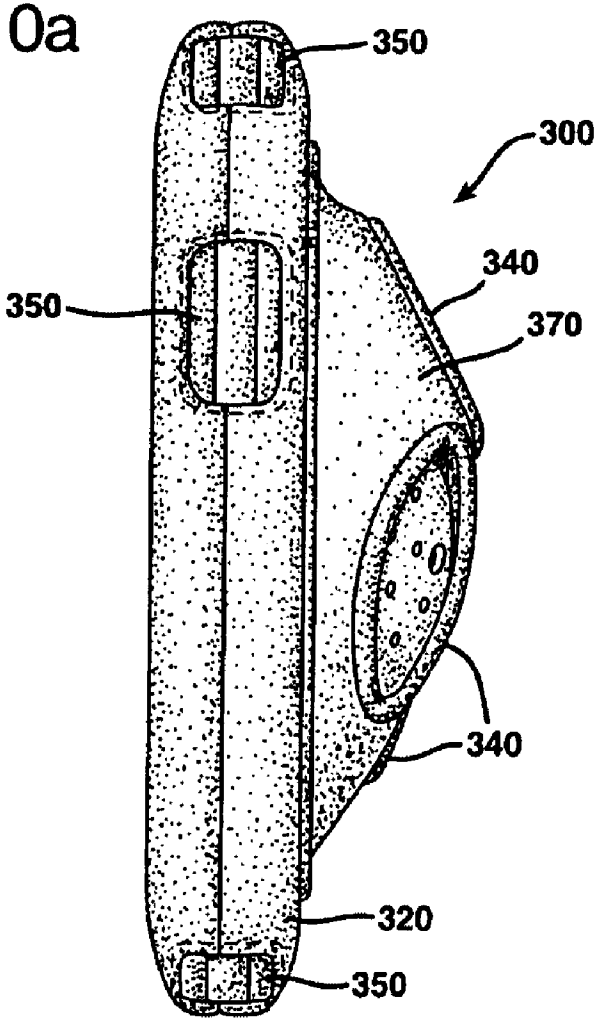

FIGS. 10*a* and 10*b* are side views of the ear guard 300 shown in FIG. 9. As can be seen, the ventilation areas 340 protrude through apertures in the dome-shaped central portion 370.

Figure 11:
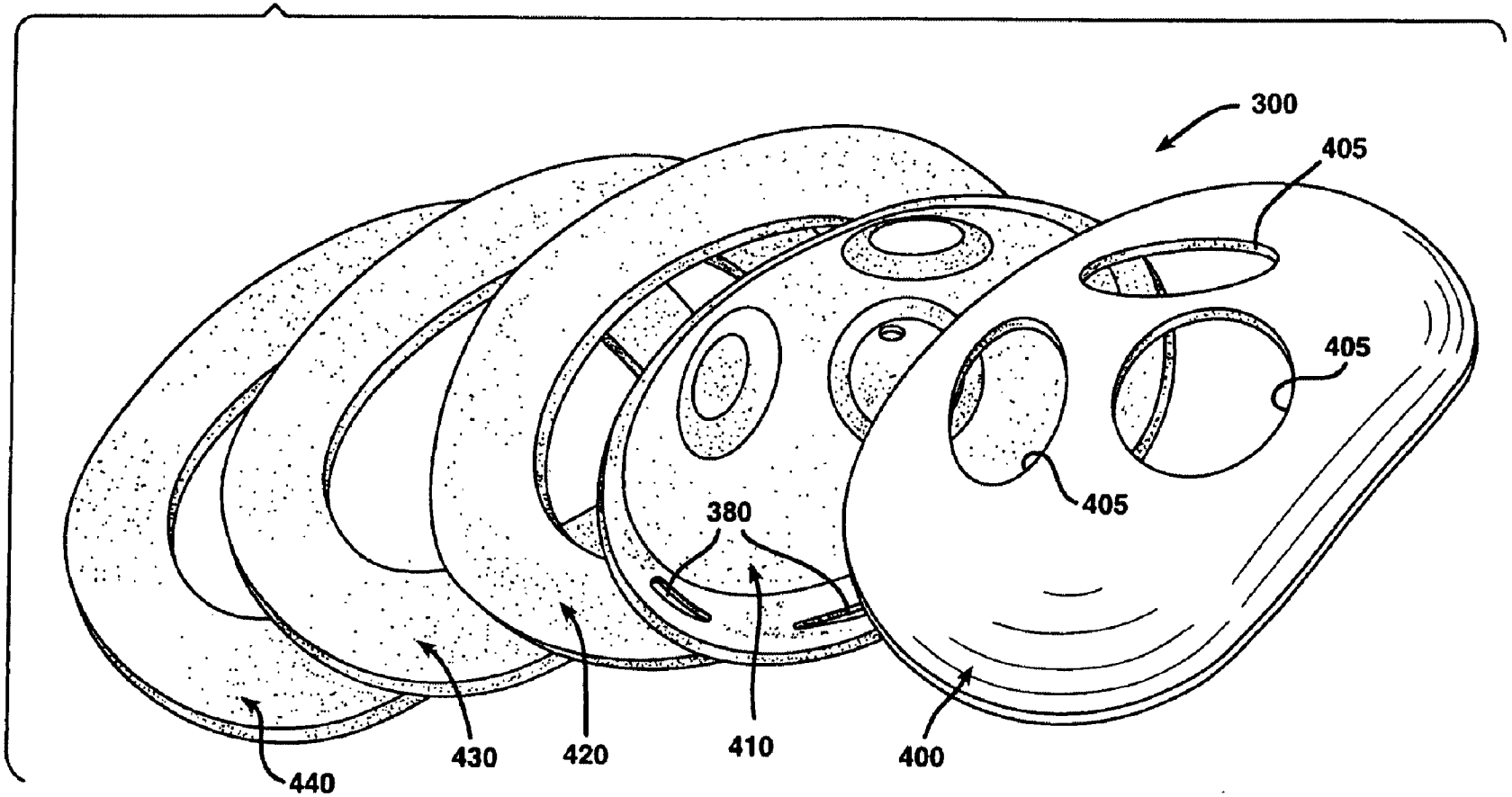
FIG. 11 is an exploded perspective view of the ear guard of FIG. 9.

FIG. 11 is an exploded perspective view showing the ear guard 300 of FIG. 9. An outer wall 400 is provided, and includes a plurality of apertures 405, which are disposed generally radially from the center of the outer wall 400. Outer wall 400 is preferably manufactured from a compressed material, such as EVA or other suitable material, and can be covered with a nylon laminate to provide a smooth outer surface. A shell 410 provides a generally dome-shaped cavity for receiving the ear of a wearer, and includes raised ventilation areas 340 disposed generally radially about the center of the shell 410. Each of the ventilation areas 340 includes a plurality of apertures for allowing the transmission of sound and air. Each of the ventilation areas 340 align with the apertures 405 of the outer wall 400, so that the ventilation areas 340 protrude through the outer wall 400. The shell 410 could be manufactured from a suitably rigid material, such as polypropylene, and includes a plurality of slots 380 for receiving the ends of head and chin straps. A landing pad 420 is attached to the perimeter of the shell 410, and can be manufactured from compressed EVA or other similar material.

An inner wall 440, preferably manufactured from neoprene or other similar material, is attached at the perimeter thereof by any suitable mean, such as by stitching, to the outer wall 400. A cushion layer 430, manufactured from a foam material aligns with the landing pad 420, and is preferably included in the inner wall 440. The construction and stitching of the inner wall 440, the cushion layer 430, the interior wall, and the landing pad 420 can be identical to the ear guard 30 described earlier.

Having thus described the invention in detail, it is to be understood that the foregoing description is not intended to limit the spirit and scope thereof. What is desired to be protected by Letters Patent is set forth in the appended claims.

What is claimed is:

1. Protective headgear comprising:

a pair of ear guards;

a head support including:

first and second lateral straps interconnecting the ear guards; and a transverse strap interconnecting the first and second lateral straps, the transverse strap including:

a central portion;

forward legs connected between the central portion and the first lateral strap; and rear legs connected between the central portion and the second lateral strap;

and an adjustable chin strap interconnected between the pair of ear guards.

2. The headgear of claim 1, wherein one of the forward and rear legs are adjustably attached to corresponding first or second lateral straps.

3. The headgear of claim 1, wherein ends of the forward or rear legs are inserted through slots in the first or second lateral straps and attached back to the forward or rear legs with a hook-and-loop fastening system.

4. The headgear of claim 2, wherein the other of the forward or rear legs are adjustably attached to corresponding first or second lateral straps.

5. The headgear of claim 1, wherein the first lateral strap, the forward legs, and the transverse strap are formed in a single piece.

6. A head strap for protective wrestling headgear comprising:

a pair of strap walls;

a cushioning material disposed between the pair of strap walls, edges of the strap walls attached together to retain the cushioning material;

ear guards interconnected with the ends of the straps, wherein the cushioning material cushions a wearer's forehead when the headgear is worn.

7. The head strap of claim 6, further comprising welts covering ends of the strap through the strap walls and the welts to form the strap.

8. The head strap of clam 6, wherein the head strap comprises a lateral strap connecting a pair of ear guards.

9. The head strap of claim 6, wherein the head strap comprises a chin strap.

10. An ear guard for protective headgear comprising:

an outer wall;

a rigid shell;

a landing pad attached to a perimeter of and extending beyond the shell; and an annular inner wall attached at a perimeter thereof to the outer wall.

11. The ear guard of claim 10, further comprising an annular cushioning material and retained by an annular backing, the annular cushioning material aligned with the landing pad.

12. The ear guard of claim 10, wherein the shell further comprises a plurality of apertures for allowing air and sound to transmit through the shell, the outer wall including a corresponding aperture having a mesh cover.

13. The ear guard of claim 10, wherein the landing pad comprises ethylene vinyl acetate.

14. An ear guard for protective headgear comprising:

an outer wall having a plurality of apertures;

a rigid shell defining a cavity for receiving a wearer's ear, the shell including a plurality of raised ventilation areas protruding through the apertures in the outer wall;

a landing pad attached to a perimeter of the shell; and an inner wall attached at a perimeter thereof to the outer wall.

15. The headgear of claim 14, wherein each of the ventilation areas includes a plurality of apertures.

16. The ear guard of claim 14, further comprising an annular cushioning material disposed along the inner wall and retained by an annular backing, the cushioning material aligned with the landing pad.

17. The headgear of claim 16, wherein the landing pad comprises ethylene vinyl acetate.

18. The headgear of claim 16, wherein the plurality of raised ventilation areas comprises three raised ventilation areas.

19. The headgear of claim 18, wherein the plurality of apertures in the outer wall comprises three apertures in the outer wall.

20. The headgear of claim 19, wherein the three raised ventilation areas extend through the three apertures in the outer wall.

21. The headgear of claim 18, wherein the plurality of raised ventilation areas are disposed radially about the center of the rigid shell.

22. The headgear of claim 18, wherein the plurality of apertures in the outer wall are disposed radially about the center of the outer wall.

* * * * *